US008490913B2

(12) United States Patent
Formon et al.

(10) Patent No.: US 8,490,913 B2
(45) Date of Patent: Jul. 23, 2013

(54) RETENTION MECHANISM IN A DISPENSER AND SYSTEM COMPRISING A RETENTION MECHANISM AND AN END PLUG

(75) Inventors: John S. Formon, Oxford, PA (US); Craig Weber, Philadelphia, PA (US); Robin Wallman, Radnor, PA (US)

(73) Assignee: SCA Hygiene Products AB, Göteborg (SE)

( * ) Notice: Subject to any disclaimer, the term of this patent is extended or adjusted under 35 U.S.C. 154(b) by 309 days.

(21) Appl. No.: 12/938,599

(22) Filed: Nov. 3, 2010

(65) Prior Publication Data

US 2012/0104144 A1 May 3, 2012

(51) Int. Cl.
*B65H 75/18* (2006.01)

(52) U.S. Cl.
USPC ..... 242/599.3; 242/596.7; 242/597.6

(58) Field of Classification Search
USPC ..... 242/597.5, 597.6, 599, 599.4, 599.3, 242/596, 596.7
See application file for complete search history.

(56) References Cited

U.S. PATENT DOCUMENTS

| | | | | |
|---|---|---|---|---|
| 1,046,474 | A * | 12/1912 | Marcuse | 242/599.4 |
| 1,704,614 | A * | 3/1929 | Johnston | 242/599.4 |
| 2,905,405 | A | 9/1959 | Burton et al. | |
| 6,749,149 | B1 | 6/2004 | Friesen | |
| 7,780,112 | B2 * | 8/2010 | Granger et al. | 242/599.3 |
| 7,828,241 | B2 * | 11/2010 | Granger | 242/599.3 |
| 7,975,957 | B2 * | 7/2011 | Lind et al. | 242/596.7 |
| 8,006,929 | B2 * | 8/2011 | Lind et al. | 242/596.7 |
| 8,061,645 | B2 * | 11/2011 | Granger | 242/599.3 |
| 2004/0211853 | A1 * | 10/2004 | Inana et al. | 242/596.4 |

FOREIGN PATENT DOCUMENTS

| | | | |
|---|---|---|---|
| EP | 0 657 134 | B1 | 11/1997 |
| EP | 1 795 479 | A1 | 6/2007 |
| FR | 2879090 | A1 | 6/2006 |
| WO | 2005/094653 | A1 | 10/2005 |
| WO | 2007/038957 | A1 | 4/2007 |
| WO | 2005/094652 | A1 | 10/2008 |

OTHER PUBLICATIONS

Notification of Transmittal of the International Preliminary Report on Patentability dated Apr. 3, 2013 issued in the corresponding PCT Patent Application No. PCT/EP2011/067458.

* cited by examiner

*Primary Examiner* — William A Rivera
(74) *Attorney, Agent, or Firm* — Buchanan Ingersoll & Rooney PC

(57) ABSTRACT

A retention mechanism (40) for a dispenser for retaining an end plug (10) of an exchangeable roll of material includes an insertion slot extending between a receiving end (54) and a seating region (50) for inserting a bearing pin (22) of the end plug. The bearing pin has at least a first portion (26) with a first diameter, and a second portion (28) with a second diameter smaller than the first diameter. A pin discriminator (46) is at least at the receiving end and narrows the receiving end so only bearing pins can enter the receiving slot which have a maximum outer diameter in the second portion which equals the second diameter. A rejecting slot (48) extends from the seating region and is dimensioned so only bearing pins with a predetermined maximum diameter in the first portion which is smaller than the first diameter will enter the rejecting slot.

16 Claims, 6 Drawing Sheets

Fig. 1
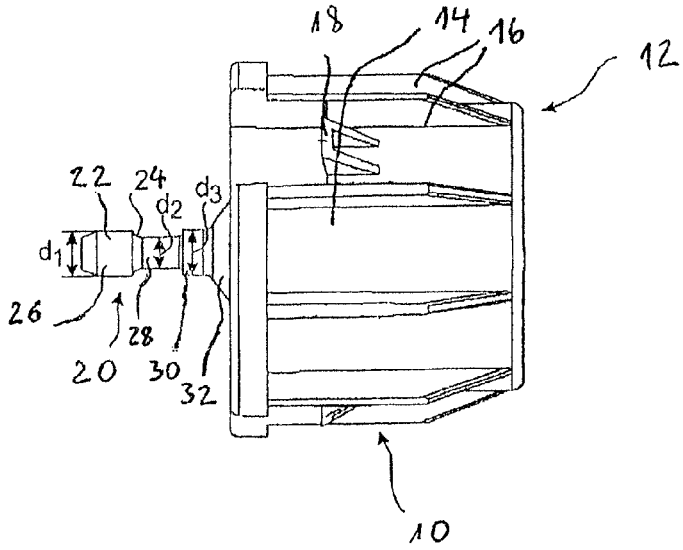
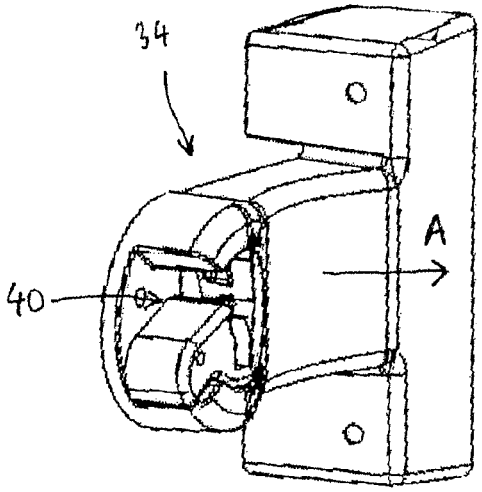
Fig. 2
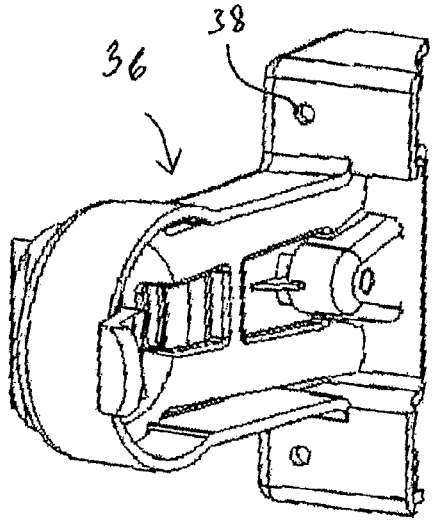
Fig. 3

RETENTION MECHANISM IN A DISPENSER AND SYSTEM COMPRISING A RETENTION MECHANISM AND AN END PLUG

TECHNICAL FIELD

The invention relates to a retention mechanism in a dispenser for retaining an end plug of an exchangeable roll of material. Further, the invention relates to a system of a retention mechanism and an end plug of an exchangeable roll of material in a dispenser.

RELATED ART

Numerous dispensers for dispensing hand towels, paper towels, toilet paper, foil, plastics wrapping sheet and other materials wound onto a roll are known in the art. Usually, such dispensers are provided with a supporting frame having support members in the form of arms upon each of which an end of an exchangeable roll is rotatably mounted. In one solution a support arm carries a hub member supported thereon over which one end of the roll core is inserted when replacing the roll. To the other end of the roll, an end plug is secured which is inserted in a catcher mechanism in the other support arm of the dispenser. By means of providing an end plug only on one side of the roll, the correct placement of the supply roll relative to the dispensing mechanism and, consequently, the proper feeding of the sheet material is ensured.

Different suggestions have been made in order to ensure the proper feeding of dispensers or to prevent the insertion of unauthorized paper rolls of inferior quality into the dispenser. EP 0 657 134 B1 provides a solution to the problem to prevent the wrong insertion of paper rolls into a dispenser. The paper rolls are provided with plugs on both sides, the plug on the one side having a larger diameter and a slit which divides the pin into two crescent-shaped segments. This geometry is adapted to match a specific receiving geometry of the dispenser which is provided with corresponding depressions for receiving the crescent-shaped segments of the bearing pin being part of the plug.

Based on the object to prevent unauthorized paper rolls, U.S. Pat. No. 2,905,405 describes a coupling mechanism having openings of a special shape within a flange plate of the dispenser. The end plugs of the exchangeable replacement rolls have matching projections to be inserted through these openings. The projections of the end plugs inserted through the openings press on leaf springs biasing them into a position in which they do not impede the proper operation of the dispenser. Only replacement paper rolls having all matching projections can be used in order to operate each individual leaf spring.

Another similar technical solution is known from U.S. Pat. No. 6,749,149 B1. The dispenser described therein has support arms for supporting a paper towel roll having a selected geometry with protrusions shaped to fit into matching openings in the end faces of the paper towel roll.

WO 2005/094653 A1 describes a lock mechanism for a dispenser in combination with an exchangeable roll of material which provides a key-lock-system which is easy to operate if an exchangeable roll of material is provided with at least one end plug of the right geometry. The key of the system is the geometry of the bearing pin of the end plug, whereas the lock of the system is part of the dispenser. The dispenser is provided with a lock housing with a guide slot for insertion of the bearing pin. The guide slot is subdivided into sections of different width wherein the different sections are arranged such that they extend in a longitudinal direction of the bearing pin of the end plug to be received. This key-lock-system prevents the introduction of a plug with wrong dimensions, and additionally provides a safety means ensuring the proper longitudinal position of the replacement roll when inserting into the dispenser.

The above-described solutions serve the purpose to ensure the proper insertion of a roll of material provided with the matching geometry to some receiving structure. However, such paper rolls having a specific geometry with projections to be inserted in corresponding depressions in the receiving geometry are difficult to handle. The user cannot simply insert a replacement roll but has to check its proper orientation relative to the receiving structure. Further, there is the danger of wrong operation or that the user applies undue pressure to push a replacement roll into the dispenser.

SUMMARY OF THE INVENTION

It is an object of the present invention to provide a retention mechanism for a dispenser and a system of a retention mechanism and an end plug of an exchangeable roll of material such that the insertion of a replacement roll is very easy but still the inadvertent use of a wrong or unauthorized roll is effectively prevented.

This object is solved by a retention mechanism for a dispenser as broadly described herein. The system of a retention mechanism and an end plug of an exchangeable roll of material is also a part of the present invention.

The inventive retention mechanism for a dispenser for retaining an end plug of an exchangeable roll of material comprises a housing with an insertion slot extending between a receiving end and a seating region for inserting a bearing pin of the end plug. The bearing pin is provided with at least two sections, a first portion with a first diameter, and a second portion with a second diameter, the second diameter being smaller than the first diameter. The retention mechanism further comprises a pin discriminator means which is provided at least at the receiving end of the insertion slot and narrows the receiving end of the insertion slot such that only bearing pins can enter the receiving slot which have a maximum outer diameter at the second portion which equals to the second diameter. Further, the retention mechanism comprises a rejecting slot extending from the seating region, the rejecting slot being dimensioned such that only bearing pins with a predetermined maximum diameter in the first portion which is smaller than the first diameter can enter the rejecting slot.

The retention mechanism has a very simple structure and in case of the provision of the pin discriminator means as a stationary rib, there are no moving parts involved. Once an end plug of an exchangeable roll of material has been correctly received in the seating region, it can freely rotate therein. Any plug provided with a bearing pin not having the right dimensions in the first portion and second portion are rejected. In case of a wrong operation, i.e. the use of a wrong exchangeable roll with a wrong bearing pin, the user cannot readily damage the retention mechanism. The pin discriminator means is provided at the receiving end of the insertion slot and already narrows the receiving end such that bearing pins which have an outer diameter in the second portion exceeding the required one cannot even enter the insertion slot.

Wrong end plugs having generally dimensions of the bearing pins which are too small, can also not damage the retention mechanism. Such end plugs can enter the insertion slot because they are not rejected by the pin discriminator means. However, once such a plug entered the insertion slot, a user can no longer apply pressure. Such end plug travels through the insertion slot up to the seating region where it cannot be properly held. As a result of this, such a wrong end plug enters and moves through the rejecting slot where it is finally held or leaves again the retention mechanism.

Reference to a maximum outer diameter in a second portion which equals to the second diameter as well as reference to a predetermined maximum diameter in the first portion which is smaller than the first diameter indicates that care should be taken to account for possible tolerances when manufacturing the retention mechanism as well as the bearing pin of the end plug. Therefore, it is advisable to design the pin discriminator means as well as the dimensions of the rejecting slot such that also end plugs having certain, small variations in the diameter of the first portion and of the second portion can still be used. With regard to the rejecting slot, a smaller dimension of the rejecting slot has the additional advantage that the seating area within the seating region becomes larger which gives an improved support to the bearing pin of the end plug.

According to a preferred embodiment of the invention, the retention mechanism further comprises a loading ramp extending in insertion direction to the receiving end of the insertion slot and being dimensioned to support the bearing pin before entering the receiving end of the insertion slot. Such a loading ramp can be designed to have a slope going up in the insertion direction. In such a case, a wrong plug rejected by the pin discriminator means slides back down the loading ramp to be easily removed again by the user.

A further function of the loading ramp is a positioning of the bearing pin relative to the discriminating rib. By sliding up the loading ramp, the vertical position of the bearing pin relative to the pin discriminator means is defined.

Preferably, the loading ramp is provided with a positioning surface which is perpendicular to a support surface of the loading ramp and essentially parallel to the insertion direction. By providing such additional positioning surface which, in the mounted state within a dispenser, is essentially vertical, a pre-positioning of the bearing pin in an axial direction can be achieved. Such pre-positioning has the advantage that the bearing pin of the plug is correctly positioned relative to the pin discriminator means.

Preferably, such positioning surface comprises a rib extending from the support surface of the loading ramp and being arranged to abut during the insertion of an exchangeable roll of material against a step portion between the first portion and the second portion of the bearing pin. In order to achieve this, a curved rib could be used which, independently of an inaccurate loading of the roll of material onto the loading ramp, extends into the second portion of the bearing pin and moves towards the position where the step portion between the first portion and the second portion of the bearing pin should be. In such a way, an inaccurately inserted exchangeable roll of material is axially shifted and positioned during the sliding movement on the loading ramp up to the insertion slot.

According to a preferred embodiment of the invention, the insertion slot has a curved longitudinal extension and preferably is essentially vertically oriented. Such curved extension and preferably also vertical orientation prevents the undesired climbing up of the pin when the roll of material rotates. When material is dispensed, the roll rotates and the bearing pin could roll up the insertion slot if it were e.g. provided essentially horizontally.

According to a preferred embodiment of the invention, the rejecting slot extends essentially vertically and with an open end remote from the seating region. Any wrong end plug drops vertically into and through the rejecting slot. The provision of an open end has the advantage that the wrong exchangeable roll of material will leave the retention mechanism again so that it can be conveniently removed by a user without requiring lifting up of the roll of material so that the bearing pin moves up through the possibly curved insertion slot and out of the receiving end of the insertion slot.

In order to achieve this, it is preferred that the retention mechanism is positioned within a retention arm of the housing. Therefore, an open end of the rejecting slot will leave the retention arm again and does not block or even damage the retention mechanism positioned within the retention arm.

Preferably, the bearing pin further comprises a third portion with a third diameter being larger than the second diameter, the second portion being situated between the first portion and the third portion and forming a circumferential groove between the first portion and the third portion. In such a case, it is preferred that the pin discriminator means is a rib with a width which corresponds to the width of the groove. In other words, the provision of a third portion generates a further discriminating criterion. Now it is not only the rough position and diameter of the second portion which is used to allow the entrance of a bearing pin in the insertion slot, but also the width of the circumferential groove formed between the first portion and the third portion of the bearing pin. If the width of the groove and the depth of the groove are both of the required dimensions, the entrance to the insertion slot is possible.

Instead of the pin discriminator means being a single ridge, it is alternatively also possible to form the pin discriminator means by two parallel ridges. Such parallel ridges can be arranged such that their outer side surfaces are at a distance corresponding to the width of the groove. A further alternative is the provision of the pin discriminator means as a spinning wheel. A spinning wheel reduces the friction between the bearing pin and the pin discriminator means.

When a bearing pin forming a groove between a first portion and a third portion is used, the bottom of the groove preferably has a complex cross-sectional shape which is complementary to the shape of the bottom of the groove. This provides a key-lock function which could be used for a further discrimination of a specific type of exchangeable roll of material within a dispenser. If a certain type of dispenser can be used for dispensing different types of material, such specific discriminator means could be used to identify the specific type of material and, accordingly, to adjust further parameters like the dispensing length for each single dispensing operation.

The insertion slot has preferably a first guide surface and a second guide surface opposite to the first guide surface. At least in the seating region, the first guide surface has a geometry complementary to the shape of the bearing pin. This means that, in the seating region, a high surface contact area between the seating region and the bearing pin can be realized. A further advantage resides in the fact that an inadvertent axial movement of the roll of material can be effectively prevented because the correct axial positioning is maintained by the shape of the guide surface complementary to the shape of the bearing pin. This positioning function is achieved already when at least the first guide surface has such a geometry. However, it is preferred that, at least in the seating region, both guide surfaces have a geometry complementary to the shape of the bearing pin. This has the specific advantage that the loading on the tip of the bearing pin becomes more symmetrical.

The inventive system of a retention mechanism and an end plug of an exchangeable roll of material in a dispenser has at least one retention mechanism mountable in the housing of the dispenser, wherein the at least one retention mechanism is designed to hold an end plug in a seating region. Further, each end plug comprises a fitting portion dimension to fit into a hollow core of the roll of material, and a bearing pin extending from the fitting portion. The bearing pin is provided with at least three sections. A first portion with a first diameter, and a second portion with a second diameter, the second diameter being smaller than the first diameter, and a third portion with a third diameter being larger than the second diameter, the second portion being situated between the first portion and the third portion in forming a circumferential groove between the first portion and the third portion. The retention mechanism further comprises an insertion slot extending between a receiving end and the seating region and a rejecting slot extending from the seating region. The retention mechanism further comprises a pin discriminator rib provided at the receiving end of the insertion slot. The retention mechanisms and the end plug are shaped such that a pin discriminator rib prevents end plugs to enter the insertion slot which have a diameter in a second region which is larger than a predetermined diameter, whereas the rejecting slot is dimensioned such to receive end plugs with a bearing pin, the diameter of the first portion and/or third portion of which is smaller than a second and/or third predetermined diameter. The retention system as such only works properly if both the retention mechanism and the end plug are dimensioned such as to allow the bearing pin to enter the insertion slot and to be held in the seating region of the insertion slot. Any end plug which does not meet the above-described requirements with regard to the predetermined diameter in the second portion and a second and/or third predetermined diameter in the first and/or third portion do not fulfill the requirements for a successful loading of the dispenser so that such end plug is either rejected by the pin discriminator rib or through the rejecting slot within the retention mechanism.

The retention mechanism and the pin side arm of the dispenser can be a unitary structure. However, it is preferred that the retention mechanism is a separate part mounted to the pin side arm of the dispenser. This makes it possible to easily replace the retention mechanism if damaged or worn or to update the dispenser to a new generation of retention mechanism.

The inventive retention mechanism and system is of a very simple structure because there are no moving parts required. Nevertheless, the retention mechanism is able to provide a highly accurate positioning of the end plug of an exchangeable roll of material. Wrong materials are easily rejected without the possibility that a user can apply force which could lead a damage of the retention mechanism and dispenser. Due to the simple structure, the retention mechanism can be manufactured easily and with low costs.

BRIEF DESCRIPTION OF THE DRAWINGS

In the following, exemplary embodiments of the invention will be described in detail with reference to the drawings, in which FIG. 1 is a side view of an end plug;

FIG. 2 is a pin side arm of the dispenser;

FIG. 3 is a hub side arm of the dispenser;

DETAILED DESCRIPTION OF THE PREFERRED EMBODIMENTS

Figure 4:
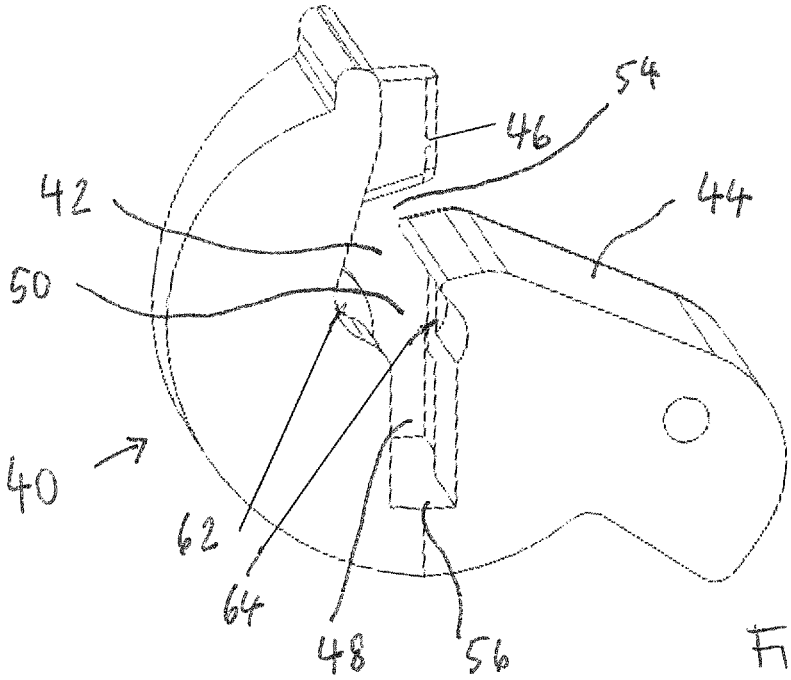
FIGS. 4 to 6 show different views of an embodiment of the retention mechanism according to the invention.

In the following description of preferred embodiments of the invention, corresponding parts or elements in the different drawings will be denoted by the same reference numerals.

FIG. 1 is a side view of an end plug 10. The end plug 10 has a fitting portion 12 with dimensions to fit into a hollow core (not shown) of a roll of material (not shown), in particular a roll of tissue paper material such as paper towels or toilet paper. The fitting portion 12 comprises a cylindrical portion 14 and a plurality of ribs 16 that extend radially from the cylindrical portion 14. The hollow core of the roll of material is fitted onto the summit portions of the radially extending ribs 16. At least one fluke portion 18 is also extending radially from the cylindrical portion 14 of the fitting portion 12 and serves to hold the hollow roll of material in place when the end plug is fitted into the core. The fluke portions 18 extend beyond the radial extension of the ribs 16 such that they enter into the core material in order to secure the end plug in the core.

The end plug 10 further comprises a bearing member 20 with a bearing pin 22 which, in the specific embodiment as shown in FIG. 1 has a counter surface 24 that faces into the direction of the fitting portion 12.

The bearing pin 22 is formed by a first portion 26 with a first outer diameter $d_1$ that merges into a second portion 28 of the bearing pin that has an outer diameter $d_2$, whereas the first diameter $d_1$ is larger than the second diameter $d_2$. The counter surface 24 is situated between the first portion 26 and the second portion 28 of the bearing pin 22. The counter surface 24 may have different forms and be inclined with respect to the longitudinal axis of the bearing pin, perpendicular to the longitudinal axis of the bearing pin 22 or chamfered.

Furthermore, the bearing pin 22 includes a third portion 30 of a third outer diameter $d_3$ whereas the third outer diameter $d_3$ is shown in the embodiment to be equal to the first diameter $d_1$. However, it is not necessary that the first diameter and the third diameter are equal, or that the third portion 30 be provided at all. Moreover, the first portion 26 may be on either side of the second portion 28.

Therefore, reference to a first and a second portion may also apply to the third and second portion as described in this embodiment.

The bearing member 20 also includes an inclined surface 32 connecting the bearing pin 22 to the fitting portion 12. Such inclined surface 32 can be used for locking the end plug in an end position in the retention mechanism as is described in EP 1 795 479 A1 incorporated herein by reference. In this case, the inclined surface is inclined with respect to a longitudinal axis of the bearing pin by an angle in the range of 117° to 141°, preferably 120° to 122°, and most preferably of 121.1°.

In the end plug as shown in FIG. 1, the inclined surface 32 and the counter surface 24 are arranged such that they are inclined in opposite directions. In other words, the two surfaces may optionally be arranged to constitute a potential well.

In a preferred embodiment the end plug is of one-piece construction and is formed of injection molded plastic material, although it is within the scope of the invention to form the end plug from plural parts and to use other materials.

FIG. 2 shows a pin side arm 34 which is part of the dispenser and is provided with a retention mechanism 40 as described later in more detail. The retention mechanism can be integrally provided in the pin side arm as a unitary structure. However, it is preferably provided separately.

The pin side arm 34 can be fitted in any suitable way to the housing of the dispenser. Although FIG. 2 shows the pin side arm 32 to have a slightly curved shape, this is just an exemplary geometry. It is also possible that the pin side arm is spring biased in the direction of arrow A so that variations in the length of the paper roll to be held between pin side arm 34 and the hub side arm 36 as shown in FIG. 3 can be accounted for. Also the hub side arm 36 serves to be attached to the housing of a dispenser. Such attachment can be made in any suitable way e.g. by using the fixing holes 38 schematically shown both for the pin side arm 34 and the hub side arm 36. It is also possible to provide a pin side arm incorporating a retention mechanism 40 on both sides of the roll.

Figure 5:
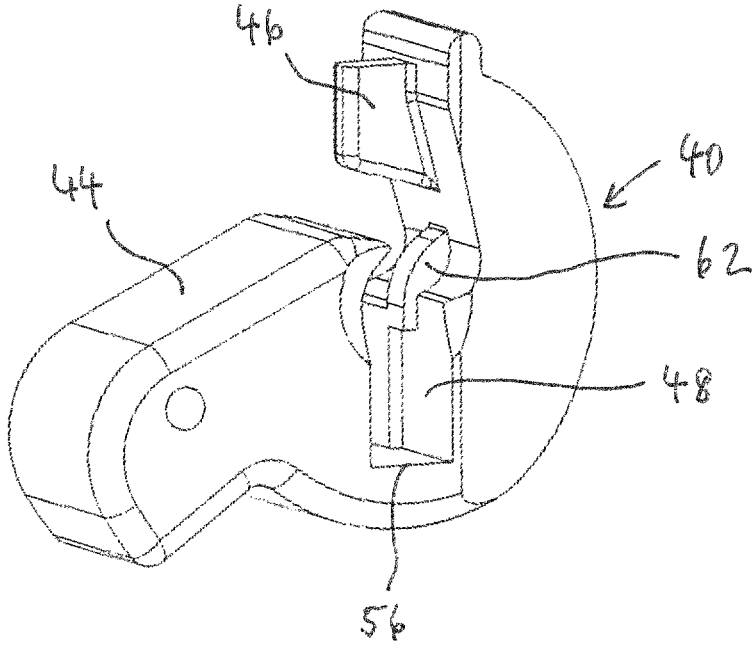
Figure 6:
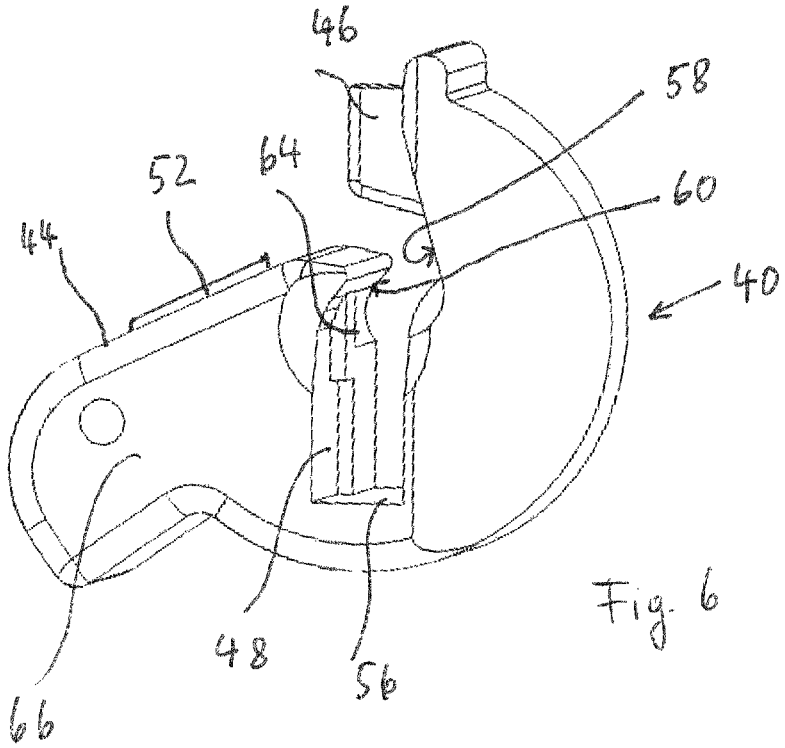

FIGS. 4 to 6 show different views of the retention mechanism 40 which is received in the pin side arm 34 as shown in FIG. 2. Another example showing how a retention mechanism 40 is received in a pin side arm 34 will later be described with reference to FIG. 7.

The retention mechanism is a three-dimensional structure with the main components of an insertion slot 42, a loading ramp 44, a pin discriminator means 46, a rejecting slot 48 and a seating region 50.

The loading ramp 44 is a sloped surface which, in the embodiment as shown in FIGS. 4 and 5 is essentially flat. FIG. 6 shows another embodiment in which the loading ramp 44 is not flat but is provided with an additional pre-positioning rib 52 extending from the surface of the loading ramp 44. The loading ramp serves to guide the bearing pin of the end plug upwards and towards the insertion slot. If a user tries to insert a wrong end plug with a wrong bearing pin into the retention mechanism, one possible way of rejecting a wrong end plug is already to deny access to the insertion slot 42. In that case, the loading ramp is useful in that the bearing pin will automatically slide back towards the user who can easily realize that the retention mechanism rejects the unsuitable end plug.

The insertion slot 42 has a receiving end 54 at the upper end of the insertion slot. References to "upper end" or "lower end" or "vertical" refer to a retention mechanism correctly inserted in the pin side arm of a dispenser in its operating position, e.g. mounted to a wall. In such an operating position, the insertion slot 42 is essentially vertical between the receiving end 54 and the seating region 50. However, it is advantageous that the receiving slot is curved providing a curved path for the bearing pin of an end plug passing through the insertion slot. The general vertical arrangement and the curved path both serve the purpose to prevent the bearing pin to move back from the seating region 50 to the receiving end 52 when the paper roll correctly installed in the dispenser is rotated. In other words, the bearing pin of a plug should be prevented from riding up the insertion slot.

Starting from the seating region 50, there is a vertical rejecting slot 48 which, in the embodiment as shown in FIGS. 4 to 6, ends in a dead end 56. The function of the rejecting slot 48 will be discussed in more detail below.

The insertion slot 42 is formed between a first guide surface 58 and a second guide surface 60 (see FIG. 6). In the seating region 50, both the first guide surface 58 and the second guide surface 60 are provided with a first seating rib and a second seating rib 64. The first seating rib 62 can be best seen in FIG. 5, whereas the second seating rib is best shown in FIG. 6. These seating ribs 62 and 64 are provided for several purposes. One purpose is to support the bearing pin in an optimum way. Therefore, the seating portion is preferably provided with a complementary geometry to that of the bearing pin. It should hold the bearing pin in an optimum way so that it can spin freely. Further, the first seating rib 62 and/or second seating rib 64 maintain a correct axial position of the bearing pin during its use.

Close to the receiving end 52 of the insertion slot 42, a pin discriminator means 46 is provided which, in the embodiment as shown in FIGS. 4 to 6 is exemplified by a single rib which extends from the extension of the first guide surface 58. The pin discriminator means 46 is shaped such as to allow only bearing pins of certain dimension to enter the insertion slot. This will be described later with reference to FIG. 12. In the embodiment as shown in FIGS. 4 to 6, the geometry of the pin discriminator means 46 is relatively simple. However, more complex shapes are also possible. As a first alternative, it is possible to provide more than one rib. The pin discriminator means could consist of several parallel ribs which are arranged such as to be positioned depending on the shape of the second portion 28 in the bearing pin 22 of an end plug 10 as shown in FIG. 1. As shown in FIG. 1, the second portion 28 has a counter surface 24 in transition to the first portion 26. Therefore, the geometry of the pin discriminator means 46 could be specifically adapted to allow only pins to enter the insertion slot which follow a specific, more complex geometry having a more complex groove shape including step-wise portions or chamfered or curved surfaces. The pin discriminator means 46 can be dimensioned such as to discriminate the correct depth of a groove in the bearing pin, but also its correct width, position, and further geometrical characteristics like the complex shape of the bottom surface of a groove.

The dimensions of the pin discriminator means 46 have to be suitably adapted so that, in cooperation with the loading ramp 42 and the receiving end 54 of the insertion slot 42, the correct geometrical discrimination can be made.

The above-mentioned pre-positioning rib 52 on the loading ramp 44 as shown in FIG. 6 can provide a pre-positioning which directs the plug of an exchange roll into the correct position so that its axial position is correctly adjusted relative to the pin discriminator means. Such a pre-positioning rib 42 could use a step portion as shown in FIG. 1 between the second portion 28 and the third portion 30 in order to adjust the axial position of the end plug. However, the same function can be achieved by the vertical side surface 66 extending vertically from the loading ramp 44. Such a vertical side surface could also be used to ensure the correct axial orientation of a bearing pin and can be used as an alternative or additional measure to the pre-positioning rib 52.

Figure 7:
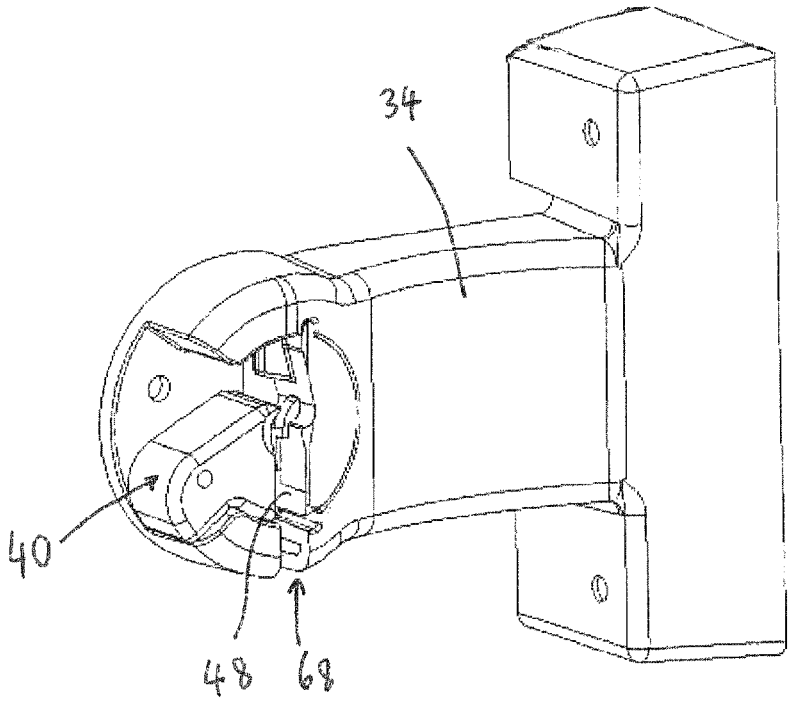
FIG. 7 shows a different embodiment of the retention mechanism incorporated in the pin side arm of a dispenser.

In the embodiments as shown in FIGS. 4 to 6, the rejecting slot 48 ended in a dead-end 56. However, it is also possible to provide the rejecting slot 48 with an open end 68 for example as shown in FIG. 7 so that end plugs rejected by the retention mechanism leave the pin side arm again and do not have to be taken out by the user through the rejecting slot and insertion slot.

In a preferred embodiment the retention mechanism is of one-piece construction and is formed of injection molded plastic material, although it is within the scope of the invention to form the retention mechanism from plural parts and to use other materials.

Figure 8:
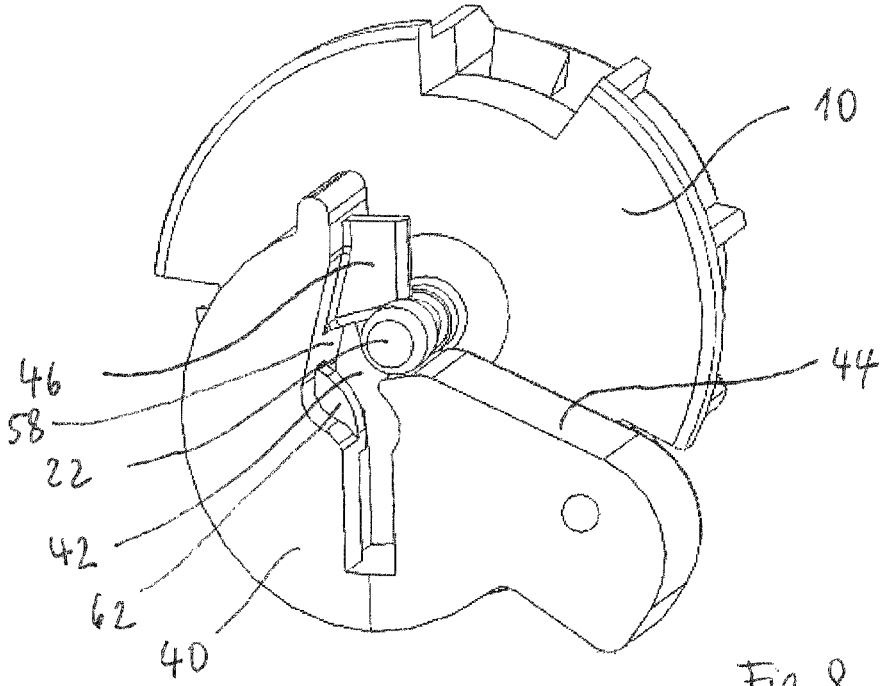
FIGS. 8 to 10 show the sequence when inserting the bearing pin of an end plug in the retention mechanism as shown in FIGS. 4 and 5.

Next, the operation of the system of a retention mechanism and an end plug will be explained with reference to FIGS. 8 to 10. FIG. 8 shows an intermediate state during the insertion operation in which the bearing pin 22 of an end plug 10 has already been slid up the loading ramp 44 and is now in contact with the upper end of the loading ramp and the pin discriminator means 46 which is positioned and dimensioned to protrude into the circumferential groove 28 identified as the second portion 28 in FIG. 1 and also shown in FIG. 9. In order to account for manufacturing tolerances of both the retention mechanism 40 and the bearing pin 22 and its exact centering on the end plug 10, the dimensions of the pin discriminator means 46 should be selected such that also in case of a maximum accumulation of tolerances the bearing pin will still be allowed to enter the insertion slot 42 of the retention mechanism 40.

Figure 9:
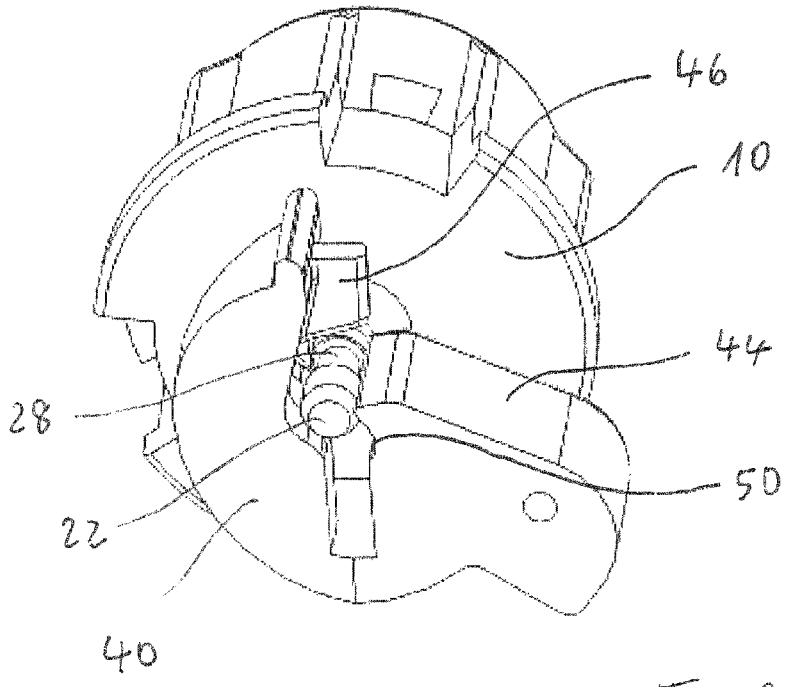

FIG. 9 shows an intermediate step during the insertion process. The bearing pin 22 of the plug 10 passed the pin discriminator rib 46 and moves through the insertion slot 42 without having reached the seating region 50. As shown in FIG. 8, the pin discriminator rib 46 and the first seating rib 62 are provided as separate ribs and the first guide surface 58 therebetween is provided as a flat surface. However, it is also possible to guide the bearing pin in the intermediate position as shown in FIG. 9 by providing an additional rib or by extending the first seating rib 62 such as to cover the whole first guide surface 58 of the insertion slot.

Figure 10:
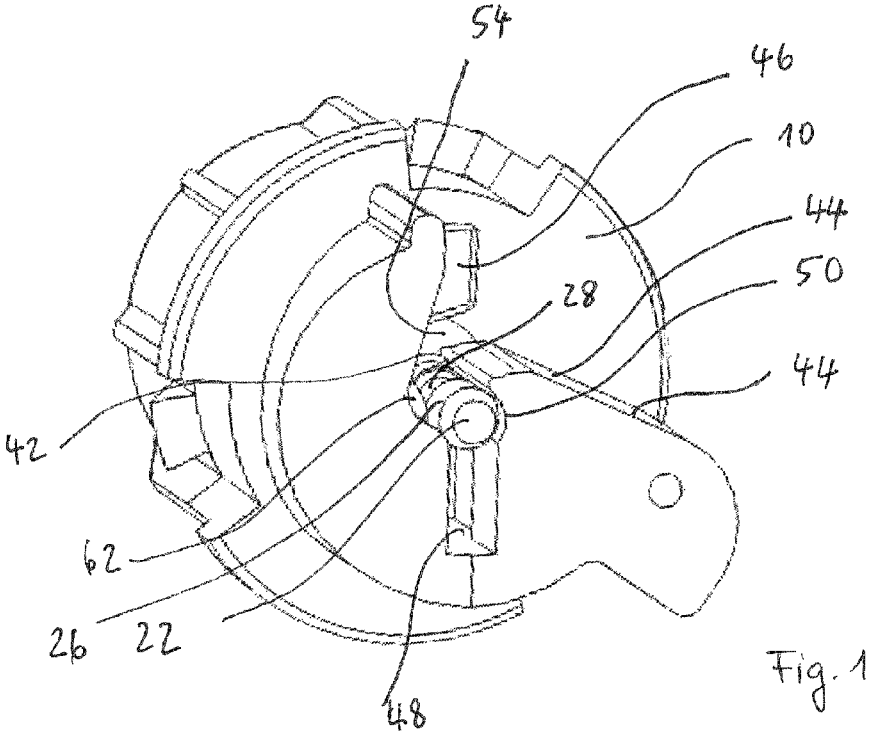

FIG. 10 shows the position in which the bearing pin 22 has reached the seating region 50 of the insertion slot. For a regular end plug 10, i.e. the end plug with the correct dimensions for the system of a retention mechanism and an end plug, this is the final operating position. The rejecting slot 48 is not entered because the dimensions of the rejecting slot are selected such that only bearing pins having an outer diameter of the first and/or second portion which is too small will enter the rejecting slot 48.

In this seating region 50, the bearing pin is held and supported by a structure which is shaped complimentary to the shape of the bearing pin 22. In this context, the first seating rib 62 and the second seating rib 64 were described with reference to e.g. FIG. 4.

Figure 11:
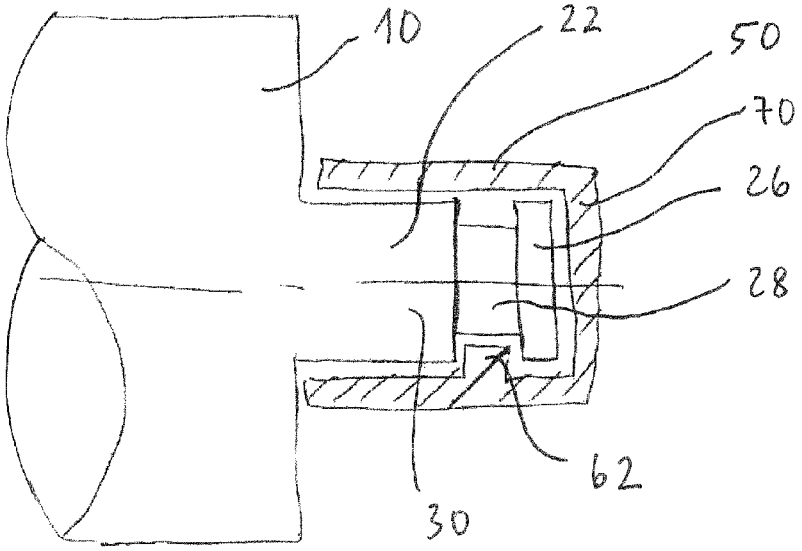
FIG. 11 schematically shows a cross-sectional view of an end plug and the surrounding retention mechanism in the seating position.

However, it is also possible to provide only the first seating rib 62 or the second seating rib 64. This is schematically shown in FIG. 11 which shows how the bearing pin 22 of the end plug 10 is seated in the seating region 50 and additionally supported and actually fixed by the first seating rib 62, whereas on the opposite side of the seating region 50 there is no second seating rib. FIG. 11 also shows that the insertion slot can be closed by a vertical wall 70 which is either part of the retention mechanism 40 or part of the pin side arm into which the retention mechanism is mounted. FIG. 11 is a schematic view with a considerable gap between the bearing pin and the surrounding structure in order to better show the seating rib 62.

Figure 12:
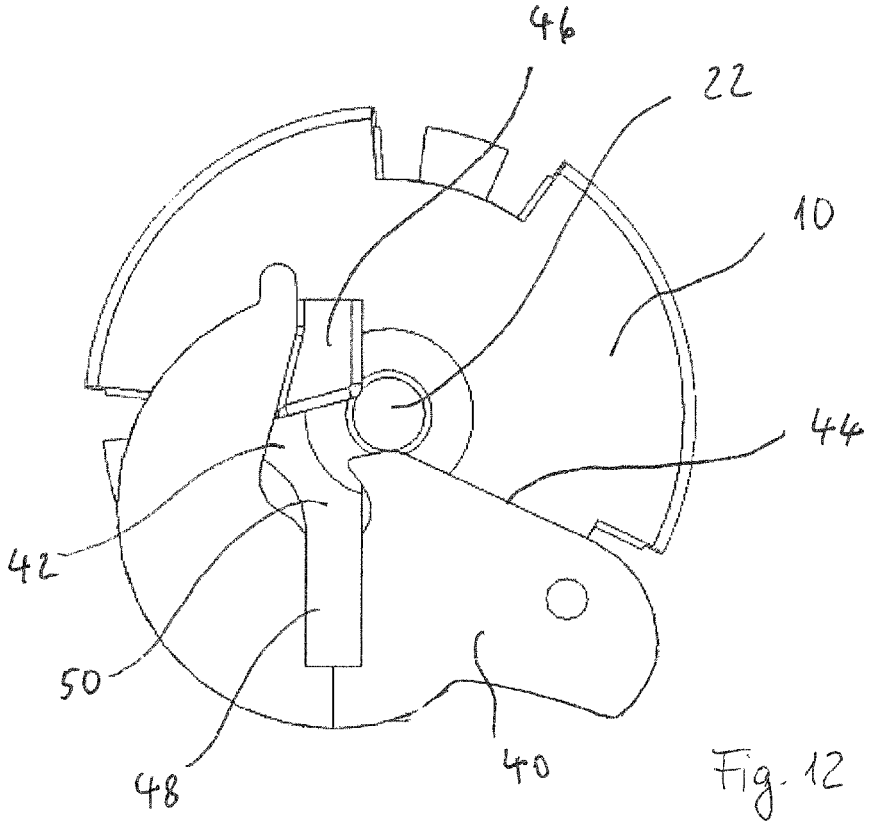
FIG. 12 shows an example how a large diameter pin is rejected.
Figure 13:
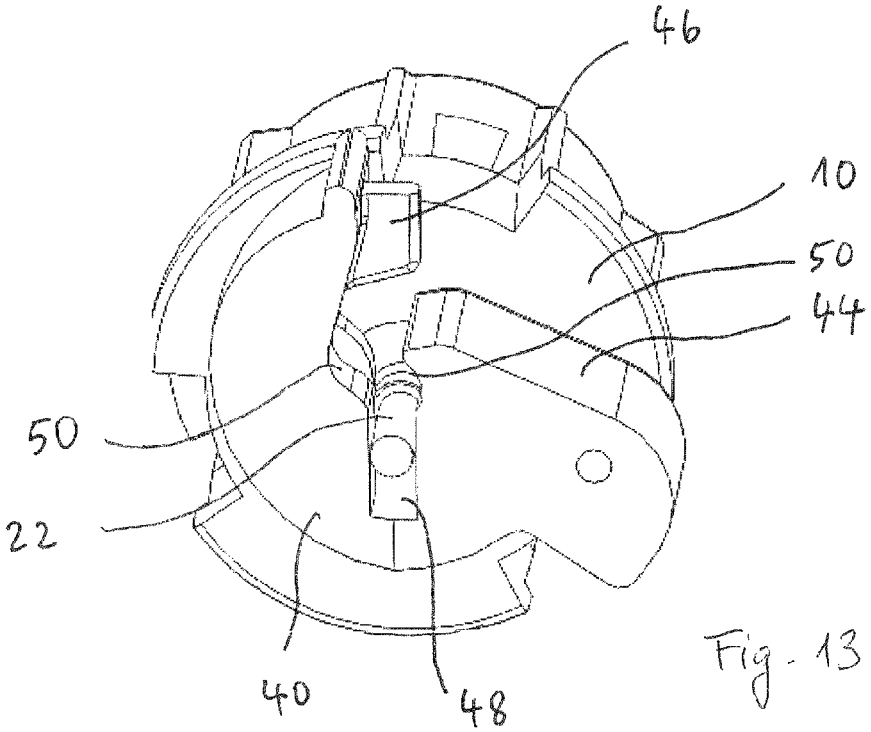
FIG. 13 shows how a small diameter pin is rejected.

The operation of the retention mechanism 38 will be explained by way of two examples with reference to FIGS. 12 and 13. FIG. 12 shows an end plug with a bearing pin without a circumferential groove. In such a case, the user can push the end plug up the loading ramp 42 with the bearing pin seated on the loading ramp 42. However, as soon as the bearing pin 22 hits the pin discriminator means, the pin discriminator means abuts against the bearing pin because it cannot extend into a recessed portion like the second portion 28 as shown in FIG. 1. In this case, the pin which is too large is rejected and cannot enter the insertion slot 42. The pin will slide back down the loading ramp 42. Even when applying undue pressure, a user will not be able to push the bearing pin into the insertion slot where it could become stuck and damage the retention mechanism 40. FIG. 13 shows another case in which the bearing pin 22 of the end plug 10 is too small. In such a case, the pin discriminator means 46 will not block the entry of such small diameter bearing pin 22 into the insertion slot. However, such small diameter bearing pin cannot be held at the seating portion 50 of the retention mechanism 40. It will enter the rejecting slot 48 and drop down to the end of the rejecting slot. The bearing pin according to FIG. 13 is just in the process of dropping down through the rejecting slot. Once the bearing pin dropped into the rejecting slot, the user will have to remove again the exchange roll of paper from the retention mechanism. Since this could be somewhat awkward to achieve, the embodiment as shown in FIG. 7 was discussed above in which the rejecting slot has an open end at the lower side of the pin side arm 32 so that the pin will completely drop out of the retention mechanism.

In the appended claims, specific embodiments of the invention are described. Wherever this is technically feasible, each and every combination of such features should also be covered by the invention.

The invention claimed is:

1. A retention mechanism for a dispenser for retaining an end plug of an exchangeable roll of material, the retention mechanism comprising:

an insertion slot extending between a receiving end and a seating region for inserting a bearing pin of the end plug, the seating region including seating ribs rigidly fixed to the seating region for maintaining a correct axial position of the bearing pin;

the bearing pin being provided with at least two portions, a first portion with a first diameter, and a second portion with a second diameter, the second diameter being smaller than the first diameter and forming a circumferential groove in the bearing pin;

a pin discriminator structure which is rigidly fixed to at least the receiving end of the insertion slot and narrows the receiving end of the insertion slot such that the pin discriminator structure protrudes into the circumferential groove when the bearing pin is in the receiving end to allow only bearing pins which have a maximum outer diameter in the second portion substantially equal to or is less than the second diameter to enter the insertion slot; and a rejecting slot extending from the seating region which is dimensioned such that only bearing pins with a predetermined maximum diameter in the first portion which is smaller than the first diameter can enter the rejecting slot, and which extends in a direction that is non-parallel to a direction in which the receiving end extends.

2. The retention mechanism according to claim 1, further comprising a loading ramp extending in insertion direction to the receiving end of the insertion slot and being dimensioned to support the bearing pin before entering the receiving end of the insertion slot.

3. The retention mechanism according to claim 2, the loading ramp being provided with a positioning surface which is perpendicular to the support surface of the loading ramp and essentially parallel to the insertion direction.

4. The retention mechanism according to claim 3, the positioning surface comprising a rib extending from the support surface of the loading ramp and being arranged to abut during the insertion of an exchangeable roll of material against a step portion between the first portion and the second portion of the bearing pin.

5. The retention mechanism according to claim 1, wherein the insertion slot has a curved longitudinal extension, and the rejecting slot is essentially vertically oriented.

6. The retention mechanism according to claim 1, wherein the retention mechanism is positioned within a retention arm of a housing of a dispenser.

7. The retention mechanism according to claim 1, wherein the rejecting slot extends essentially vertically and terminates in an open end remote from the seating region.

8. The retention mechanism according to claim 1, wherein the bearing pin further comprises a third portion with a third diameter being larger than the second diameter, the second portion being situated between the first portion and the third portion and forming the circumferential groove between the first portion and the third portion; and wherein the pin discriminator structure has a width which is less than the width of the circumferential groove.

9. The retention mechanism according to claim 8, wherein the pin discriminator structure is formed by two parallel ridges.

10. The retention mechanism according to claim 8, wherein the bottom of the groove has a cross-sectional shape, and the pin discriminator structure is a rib with a shape which is complementary to the cross-sectional shape of the bottom of the groove.

11. The retention mechanism according to claim 1, wherein the insertion slot has a first guide surface and a second guide surface opposite to the first guide surface; wherein at least in the seating region, the first guide surface has a complementary geometry to the shape of the bearing pin.

12. The retention mechanism according to claim 11, wherein at least in the seating region both guide surfaces have a geometry complementary to the shape of the bearing pin.

13. A dispenser with at least one retention mechanism according to claim 1.

14. The dispenser according to claim 13, comprising a pin side arm to which the retention mechanism is mounted.

15. The retention mechanism according to claim 1, wherein a width of the pin discriminating structure is less than a width of the circumferential groove in the bearing pin.

16. A dispenser comprising a retention mechanism and a cooperating end plug of an exchangeable roll of material, comprising:

at least one retention mechanism mounted in a housing of the dispenser;

the at least one retention mechanism being designed to hold an end plug in a seating region;

each end plug comprising a fitting portion dimensioned to fit into a hollow core of a roll of material, and a bearing pin extending from the fitting portion;

the bearing pin being provided with at least three portions, a first portion with a first diameter, and a second portion with a second diameter, the second diameter being smaller than the first diameter, and a third portion with a third diameter being larger than the second diameter, the second portion being situated between the first portion and the third portion and forming a circumferential groove between the first portion and the third portion;

the retention mechanism further comprising an insertion slot extending between a receiving end and the seating region,the seating region including seating ribs rigidly fixed to the seating region for maintaining a correct axial position of the bearing pin;

a rejecting slot extending from the seating region and in a direction that is non-parallel to a direction in which the receiving end extends; and a pin discriminator rib rigidly fixed to the receiving end of the insertion slot;

the retention mechanism and the end plug being shaped such that the pin discriminator rib protrudes into the circumferential groove when the bearing pin is in the receiving end to prevent bearing pins which have a diameter in the second region which is larger than a predetermined diameter from entering the insertion slot, and the rejecting slot being dimensioned to receive a bearing pin, the diameter of the first portion and/or third portion of which is smaller than a second and/or third predetermined diameter.

* * * * *